US005718631A

United States Patent [19]

Invencion

[11] Patent Number: 5,718,631

[45] Date of Patent: Feb. 17, 1998

[54] ELECTRONIC VIDEO GAME DEVICE

[76] Inventor: Wilson Q. Invencion, 951 Versailles Dr., Hollister, Calif. 95023

[21] Appl. No.: 559,139

[22] Filed: Nov. 17, 1995

Related U.S. Application Data

[63] Continuation-in-part of Ser. No. 333,607, Nov. 2, 1994, abandoned.

[51] Int. Cl.[6] ..... A63F 3/00

[52] U.S. Cl. ..... 463/19

[58] Field of Search ..... 463/18, 19; 273/269, 273/270, 237, 238

[56] References Cited

U.S. PATENT DOCUMENTS

| | | | |
|---|---|---|---|
| 4,121,830 | 10/1978 | Buckley | 273/138 |
| 4,218,063 | 8/1980 | Cooper | 273/237 |
| 4,312,511 | 1/1982 | Jullien | 273/269 X |
| 4,332,389 | 6/1982 | Loyd et al. | 273/237 |
| 4,378,940 | 4/1983 | Gluz et al. | 273/237 |
| 4,475,157 | 10/1984 | Bolan | 364/410 |
| 4,624,462 | 11/1986 | Itkis | 273/237 |
| 4,661,906 | 4/1987 | Di Francesco et al. | 364/410 |
| 4,747,600 | 5/1988 | Richardson | 273/237 |
| 4,798,387 | 1/1989 | Richardson | 273/237 |
| 4,848,771 | 7/1989 | Richardson | 273/269 X |
| 4,856,787 | 8/1989 | Itkis | 273/237 |
| 5,054,787 | 10/1991 | Richardson | 273/138 A |
| 5,072,381 | 12/1991 | Richardson | 273/237 |
| 5,088,928 | 2/1992 | Chan | 434/339 |
| 5,160,146 | 11/1992 | Greer | 273/269 |
| 5,178,395 | 1/1993 | Lovell | 273/238 |
| 5,242,163 | 9/1993 | Fulton | 273/85 |
| 5,297,802 | 3/1994 | Pocock et al. | 273/269 X |
| 5,432,526 | 7/1995 | Hyatt | 345/87 |

OTHER PUBLICATIONS

"The Official Turbo Grafx-16, Game Encyclopedia": King of Casino by Sandler et al. pp. 222–229, Nov. 1990.

*Primary Examiner*—George Manuel

[57] ABSTRACT

A portable electronic device for playing a bingo game for use with a television set. The device includes a conventional computer system having graphics and sound capabilities. The computer system includes a dedicated game software stored in ROM which generate pseudo-random numbers at a predetermined interval and generate sound signals to vocalize the announcement of bingo numbers. The numbers are automatically displayed on the television screen using the graphics generating function of the computer. At the same time, the generated sound signals are reproduced through the television's audio channel and speakers. The device can be linked to the television in one of three ways: a coaxial cable connected to the antenna terminals, a set of audio and video cables, or through a small television transmitter. The system is expandable by utilizing additional television sets, loud speakers and a personal computer printer. The device includes an enclosure in which a dedicated control keypad is located on the top panel and input-output terminals on the rear panel. Players may use standard bingo cards or personal electronic handsets. The device makes the playing of bingo game more entertaining, facilitates operation and greatly reduces manual operator functions. The device also defines an educational game for children.

12 Claims, 6 Drawing Sheets

ELECTRONIC VIDEO GAME DEVICE

CLAIM OF PRIORITY

This application claims priority from and is a continuation-in-part of formerly co-pending U.S. patent application, Ser. No. 08/333,607, filed Nov. 2, 1994, now abandoned the disclosure of which is hereby incorporated by reference.

BACKGROUND

1. Field of the Invention

The present invention relates to an electronic video game device, specifically to an interactive display and audio system implemented using a programmed digital computer for playing bingo.

2. Description of the Prior Art

Bingo is a popular game enjoyed by people of all ages throughout the World. It is a favorite pastime and one of the most commonly used games for raising funds by various organized groups such as schools, churches and other non-profit organizations. Bingo provides excitement and entertainment to players and enthusiasts, which makes the game interesting and attractive to many people. For the purpose of explanation, the phrases "bingo numbers" and "bingo balls" are used interchangeably to mean the same thing, i.e., a bingo number. Furthermore, the phrases "generating a random number" and "drawing a ball" have the same meaning.

In the current version of playing bingo, one or more persons is required to provide the following functions: operate a ball drawing device, select a ball, read and announce the ball's number, show the ball or operate a display apparatus which displays the ball's number, record the selected number, validate a winning card, verify and check the numbers, and finally award a winner. These operator functions are discussed in greater detail below.

The basic elements of a modernized bingo game are the following:

(a) pseudo-random number generator or drawing device;

(b) bingo cards;

(c) display apparatus;

(d) audio system;

(e) card validation and verification device; and (f) operator and caller.

The equipment still being used today by large bingo operators to draw numbers is a lot machine or blower unit. This blower unit is a large plastic or glass container with Ping-Pong balls or light plastic balls placed inside the container. Each ball is marked with a number from 1 to 75 (or 90) and the corresponding bingo letter (e.g. I-17). Forced air produced by an electric fan blows the balls to mix them and an operator draws a ball at random through an opening. The operator will then read the number on the ball and announce the number. The operator or caller has to shout out loudly and clearly so that the players can understand each call. In large bingo halls, an audio amplifier and loud speaker system are used to make this possible.

In most homes the drawing device used is a small plastic container with an opening, similar to the one mentioned above. Small balls or chips, each marked with a number and the corresponding bingo letter, are put inside the container. The balls are mixed together manually by shaking or rotating the container. An operator gets a number by drawing out a ball through the opening, one at a time, using his hands. Similarly, the operator will read the number and announce the number to the players.

The use of such mechanical devices is awkward, inconvenient and cumbersome. Several patented devices, such as U.S. Pat. No. 4,218,063 (1978) issued to Cooper, et. al., and U.S. Pat. No. 5,178,395 (1993) issued to Lovell, still largely depend upon the conventional system of drawing numbers. Another serious disadvantage with these mechanical devices is that an operator can defeat the devices by easily manipulating or tampering with, to some player's advantage, thus making the game unfair to other players. Since these mechanical devices depend largely on an individual to operate them, these are not reliable.

The standard bingo cards are made of sheets of paper or cardboard on which the numbers are pre-printed. Players use daubers, ink markers, chips or other things to mark or cover the numbers that are called. An example of this is presented in U.S. Pat. No. 5,160,146 (1992) by Greer; which is an improved multiple bingo game sheet. Most standard bingo cards are reusable while others are disposable. Several electronic bingo cards or handheld bingo calculators have been made, such as those disclosed in U.S. Pat. No. 4,378,940 (1983) by Gluz; U.S. Pat. No. 4,475,157 (1984) by Bolan; U.S. Pat. No. 4,661,906 (1987) by Di Francesco et. al. and those patent issued to John Richardson: U.S. Pat. Nos. 4,747,600 (1988); 4,798,387 (1989); and 5,072,381 (1992). These electronic aids allow a single player to manage and play more cards better than using the conventional bingo cards. However, these devices relate only to bingo cards and have no provision for pseudo-random selection of numbers for the game.

The purpose of a display apparatus is to display several numerical information to the players such as the game number, the last number called, a record of numbers drawn, and the count of numbers called. Other display apparatus also shows the winning game pattern to be formed for a particular game. The apparatus still commonly used today consists of a plurality of display boards all connected to a master controller board. A separate display board is used for each numerical information. One of this type of display apparatus is disclosed in U. S. Pat. No. 4,218,063 (1980) issued to Cooper et. al. The masterboard is a console which includes numbered apertures at the top where Ping-Pong balls are placed. Beneath each aperture is a ball-actuated electrical switch which is turned on whenever a ball is present. The switches operate a display board or flashboard consisting of a plurality of lights with each light illuminating a number. Lovell, U.S. Pat. No. 5,178,395 (1993), made an improvement to the masterboard using light beams with electronic encoding and an LED display board. Both of these references relate only to display apparatus and display only the numbers that are called. Moreover, these apparatus rely on a ball drawing device and depend on an operator to operate both. Such apparatus will be separate, thus, it requires additional equipment.

Other display apparatus employs a combination of a video camera and a video monitor. The camera is focused on the last ball drawn and the image is displayed on the video monitor. This arrangement is expensive, and displays the last number drawn only.

The use of display apparatus in homes is not practical. To keep a record of the numbers drawn, some small groups of players use a marking pen and a sheet of paper. In some small bingo sets available to consumers, a small board is included where the numbered balls are placed in consecutive order. While others just depend on the balls or chips that were taken out from the ball drawing container. This is burdensome manual task and inconvenient to the operator. Therefore, there is a need for an electronic or automatic device that serves as a display board and which is practical to use by small group of players.

Another device that is necessary in a large bingo hall is reliable audio equipment. The voice of an operator or caller over a loud speaker system is still commonly used today. The announcement by the operator is sometimes not clear enough to be understood by all the players. It should be noted here that the use of an audio synthesizer or electronic sound generator for this purpose is still not popular today.

When the word "bingo" is called by a player to declare a win, there is a need to validate the winning card and verify the numbers in the card in accordance with a predetermined winning pattern. This validation process checks a card if it is entered in a game or not. The most common procedure is to do the validation and checking manually by the operator or a third person. However, some electronic devices have been made to do the validation automatically. One such device is disclosed in U. S. Pat. No. 5,054,787 (1991) issued to Richardson. This validation system requires a plurality of electronic bingo cards, all tied up to a base station or master control board, to be entered manually by the operator before the game starts. Since homes are not so equipped, the practical use of this validation device is limited. This device is used only by large operators and casinos. It is not applicable for home or private use and most household consumers cannot afford it.

Several other electronic devices have been made to automate the playing of bingo games but each has one or more disadvantages; or its application is limited. One of these is U.S. Pat. No. 4,121,830 (1978) issued to Buckley describing a computerized bingo apparatus. This includes an old design to generate pseudo-random numbers and two separate display boards. These display boards show only two items of numerical information; that is, the last number generated and the list of numbers called. The U.S. Pat. No. 4,856,787 (1989) to Itkis, describes an electronic game playing system capable of simultaneously playing poker, keno and bingo. U.S. Pat. No. 4,312,511 (1982) issued to Jullien of Canada describes an electronic bingo system. This is basically a masterboard which still uses Ping-Pong balls to turn on switches. The display board, located at a remote location, is connected to the masterboard by several long cables. This display board contains a plurality of lamps with each lamp illuminating a number. A second LED display shows only the last number drawn. This system is intended for use in large bingo halls. In a similar vein is the U.S. Pat. No. 5,178,395 (1993) to Lovell, which requires an operator to randomly draw balls and place these into a nest which senses the presence of a ball and causes the display of the ball's number. Another electronic bingo game is disclosed in U.S. Pat. No. 4,332,389 (1982) issued to Loyd, et. al. in which a claim to a late bingo can be recalled and verified. It employs five separate display units to show all the numerical information and game pattern required.

A U.S. Pat. No. 5,242,163 (1993) issued to Fulton describes a casino game system for playing bingo and other games within the casino. This system uses electronic cards which are tied up to the casino gaming devices and in turn are electrically connected to a master control station. It is a system that allows a casino player to play at a remote location in the casino. Since most places are not so equipped other than the casino, this system is to be used exclusively in casinos.

Another automated bingo System is U.S. Pat. No. 5,297,802 (1993) issued to Pocock et. al. of Canada. This system is a television show which allows a television viewer to play bingo with other viewers. The viewers join the game and place bets by using a touch-tone phone for entering data. One disadvantage of this system is that the viewer is not actually playing a game of bingo, but merely watching and waiting until the game ends. Winners are informed of their winnings through an automatic telephone dialing system. It is a system of mass audience participation and its application is limited to television game show.

In general, each of the references described herein has one or more of the following disadvantages:

(a) they require use of a mechanical apparatus or a manually operated device for drawing numbers at random;

(b) they depend largely on an individual to operate the device and announce the number;

(c) they require use of a loud speaker system;

(d) they use of one or more display units connected to a master board by means of long cables;

(e) the system or device is often not practical for home use or by small groups of players; and (f) they represent a considerable expense and are largely unaffordable to a household consumer.

SUMMARY OF THE INVENTION

The general idea of the present invention is to provide a bingo device that is applicable mainly for home use, but not limited to, which could facilitate the playing of bingo and eliminate most of the manual operating functions. This is accomplished by employing a conventional computer and a standard home television set. The choice of a television set is very advantageous because it is readily available in almost every home, as well as in most schools, offices, workplaces, restaurants and other places. The television set is used to provide several Bingo game functions, as a single multi-display apparatus and to announce the numbers.

Accordingly, the principal object of the present invention is to provide an electronic bingo game device that can be adapted to a standard home television set, and eliminate the need for a dedicated separate display apparatus, the human caller, and additional audio equipment.

Several other objects and advantages of the present invention are:

(1) to provide an electronic bingo game device which is portable and suitable for use in homes and other places where a television set is available;

(2) to provide an electronic bingo game device which provides a reliable, fair and accurate pseudo-random number generator, and is difficult to tamper with;

(3) to provide an electronic bingo game device which is simple to operate, convenient, and requires very little or no maintenance;

(4) to provide an electronic bingo game device which is inexpensive, attractive and affordable to many household consumers;

(5) to provide an electronic bingo game device which can be expandable, as an option, by connecting a small television transmitter and simply adding more television sets and loud speakers;

(6) to provide an electronic bingo game device which provides a brighter and clearer numerical display with a variety of colors, and gives a choice of a larger display by using larger television screen;

(7) to provide an electronic bingo game device which makes the announcement of numbers clearer and louder, without human voice;

(8) to provide an electronic bingo game device which adds excitement and enjoyment to players by generating sound effects and graphical animation;

(9) to provide an electronic bingo game device which can be used with a personal computer printer for printing and producing bingo cards; and

(10) to provide an electronic bingo game device which can be played by kids by displaying graphical images, symbols, figures and various pictures instead of numbers.

Another significant advantage and prominent characteristic of the present invention is to provide an automated bingo device that reduces most of the operator functions, yet it enables the players to use standard bingo cards and continue to experience as much excitement and pleasure as is customary in the manual playing of the game.

Still further objects and advantages will become apparent from a consideration of the ensuing detailed description and accompanying drawings.

DETAILED DESCRIPTION OF THE INVENTION

Figure 1A:
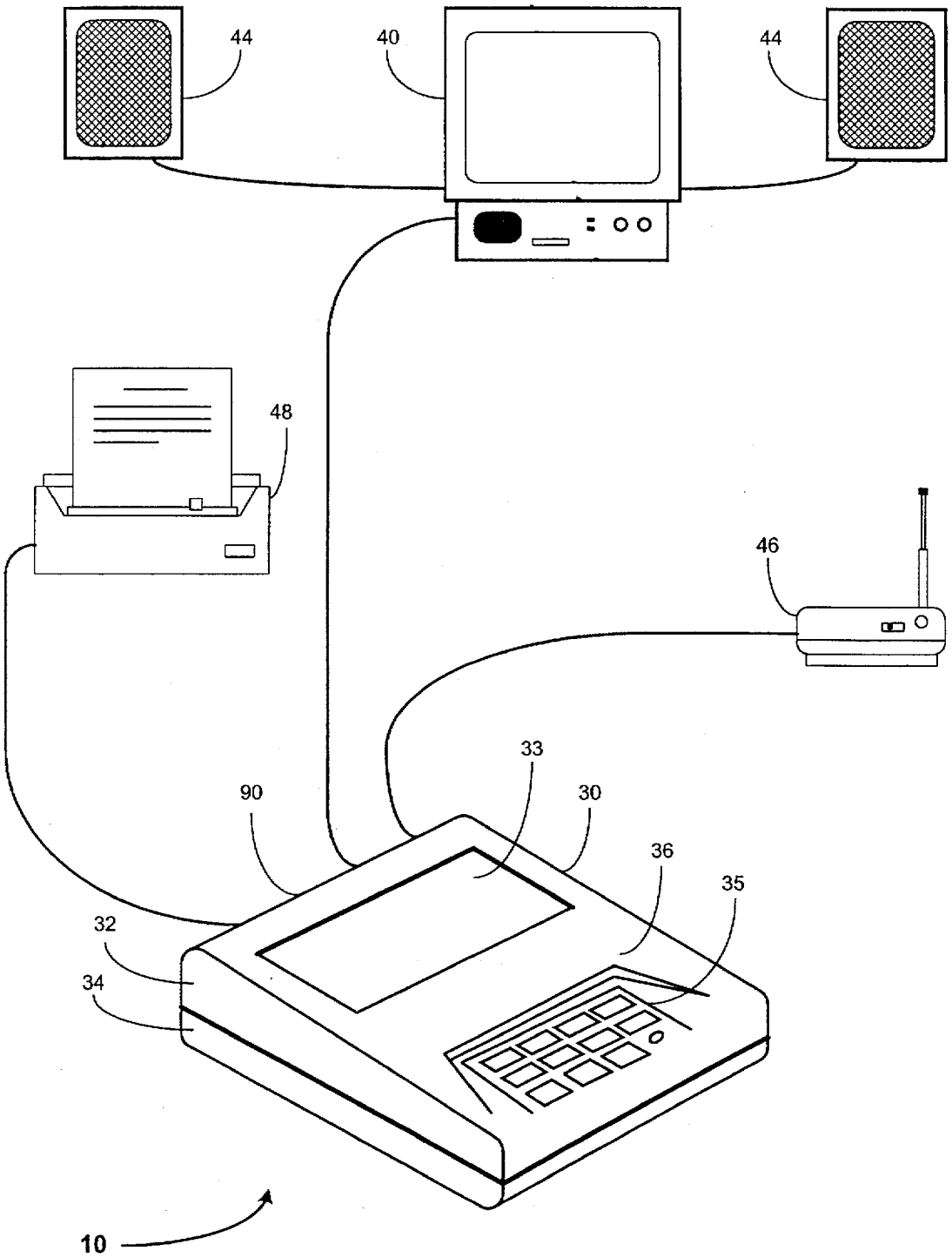
FIG. 1A is a pictorial view of an electronic video game system according to one aspect of the present invention.

FIG. 1A is a perspective view illustrating a preferred embodiment of an electronic video game system according to one aspect of the present invention, and depicted generally by the numeral 10. The video game system 10 includes a computer 30, a standard television set 40, speakers 44, an RF video transmitter 46, and a printer 48. The major elements listed here are shown being interconnected by cables.

In the preferred embodiment illustrated in FIG. 1A, the computer 30 includes a display 33 and a control keypad 35 which have been specialized for the limited purpose of the electronic video game system 10. It will be understood by those skilled in the art that the computer 30 can also be a standard desktop PC type computer or laptop with screen display. The computer 30 includes a memory having an operating system and game programs for causing the system 10 to operate as an electronic video game system. The computer 30 interprets the game programs and communicates with components of the system 10 via the interconnecting cables illustrated in FIG. 1A to provide and define an electronic video game system. The preferred video game is bingo, and the remainder of this disclosure will assume that the system 10 implements an electronic bingo game playing system.

Figure 1B:
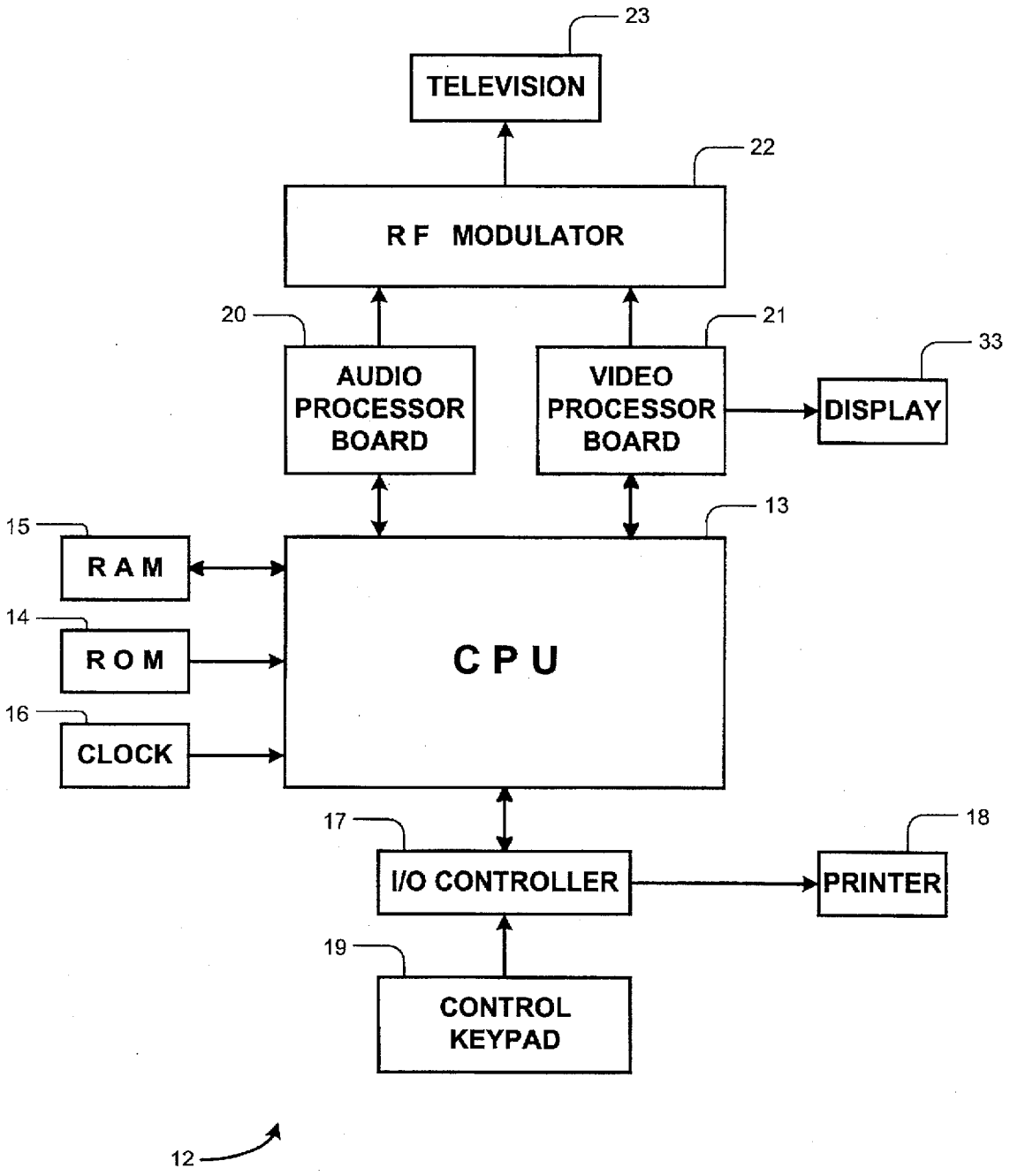
FIG. 1B is a block diagram illustrating the major components of the electronic video game system of FIG. 1A.

The manner in which the conventional parts of the system 10 cooperate to provide and define a bingo game playing system can be understood by a consideration of FIG. 1B which is a block diagram illustrating a relationship between major components of another preferred embodiment of the electronic video game system 10, and depicted generally by the numeral 12. The electronic video game system 12 includes a CPU 13, read-only memory 14 (ROM), random-access memory 15 (RAM), a clock 16, an input-output controller 17, a screen display 33,a printer 18, a control keypad 19, a sound board 20, a video board 21, a VHF modulator 22, and a television display 23.

The video game playing system 12 is made up of conventional parts which are interconnected to form the system. The read-only memory 14 includes the boot program, basic input-output, programming language, game program, printer drivers and operating systems which control the system 12 through their interpretation by the CPU 13 and define the video game playing system 12. In a preferred embodiment, the system 12 defines a bingo game playing system, as will be further developed below.

The CPU 13 is responsive to an operating system and game defining programs stored in the read-only memory 14. The CPU 13 also stores temporary results in the random-access memory 15 during the normal operation of the system 12. The CPU 13 receives time-of-day and day-of-year information from the clock 16. The system clock 16 also provide the necessary timing to the system for proper operation and synchronization.

The CPU 13 uses the controller 17 to print information on the printer 18 and receives input from the control keypad 19, which is used by an operator to control the operation of the game playing system 12. In one embodiment, the printer 18 is used by the system 12 to print bingo cards for use during play.

The game defining programs stored in the read-only memory 14 include routines for displaying game progress and results on a standard television set 23, and for producing audio output on the television set 23. For example, a synthesized voice is used in one embodiment to announce bingo numbers. The CPU 13 uses a video board 21 and a sound board 20, operating through a VHF modulator 22 to control the video and sound portions of the television set 23.

It will be appreciated by those skilled in the an that the electronic video game system 10, illustrated in FIG. 1A, is a variation of the game playing system defined by the block diagram of FIG. 1B. The system illustrated in FIG. 1A is a preferred embodiment of the more general system 12, shown in FIG. 1B. The system 10 (FIG. 1A) includes within its computer 30 the equivalents of the CPU 13, the read-only memory 14, the random-access memory 15, the clock 16, the controller 17, the sound board 20, and the video board 21. These are standard parts of many computer implemented systems and the person skilled in the art will understand how these parts cooperate to interpret stored programs to define a system. The novelty of the systems 10 and 12 resides in the combination of these standard parts with each other, the stored game defining programs and the dedicated control keys.

Before describing those game defining programs and their novel features, some of the details of the preferred embodiment of a bingo system as illustrated in FIG. 1A will be discussed.

FIG. 1A is a pictorial representation of the main unit 30 showing a game system to which the new device is applicable. The enclosure, which serves as casing and housing for the device, is a console type which is portable and suitable for video game entertainment. The ornamental appearance may be modified slightly to suit ease of operation and to make it more attractive. The enclosure comprises a lower case 32 and an upper case 34, and includes a top panel 36 and a rear panel 90. A control keypad 35, with a plurality of operating keys, is provided on the top panel 36. The rear panel 90 is attached to the lower case 32 and holds the input-output terminals and switches. The new device works in conjunction with a standard television set 40 for proper operation and an option of several other conventional devices. The game system includes a RF television transmitter 46, a personal computer printer 48, a set of loud speakers 44, and additional television sets 40. An AC/DC commercial adapter (not shown), which is supplied separately, is used to provide the necessary power for the new device.

Figure 2:
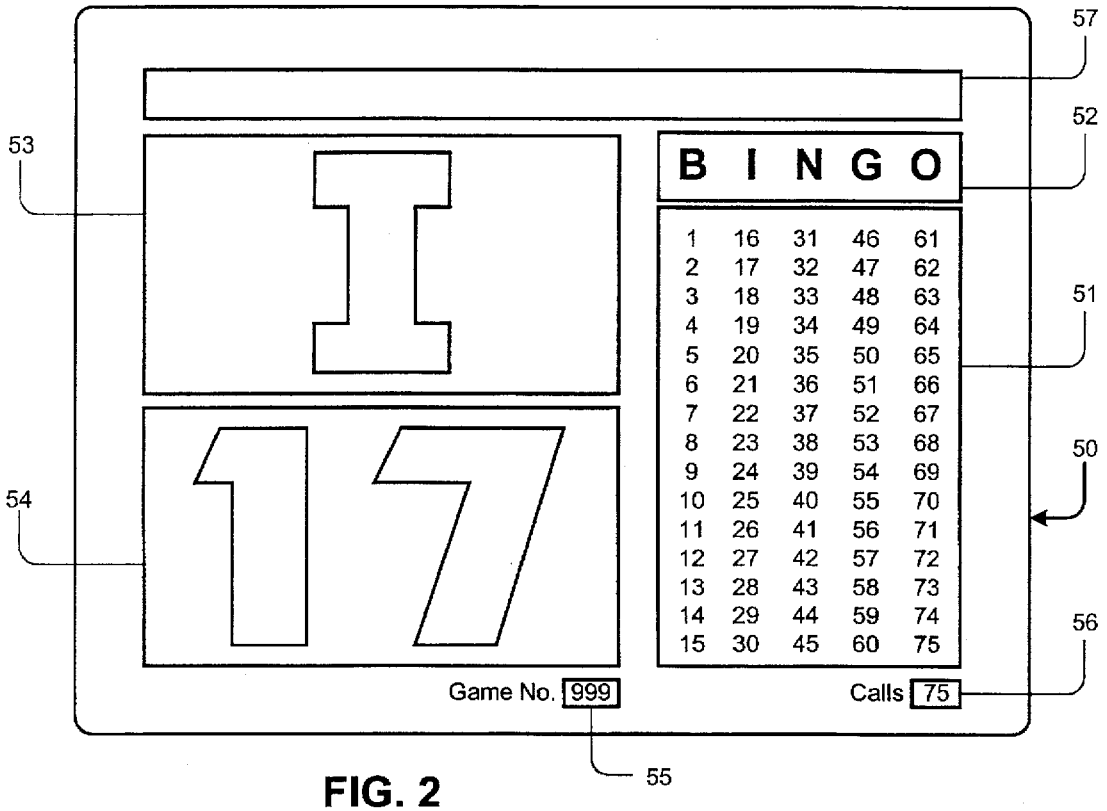
FIG. 2 is a pictorial diagram illustrating a sample television screen display of a video bingo game in progress in the system according to FIG. 1A.

FIG. 2 shows a sample television screen display 50 during a game. These are the graphical images shown on the screen most of the time while a typical game is in progress using the system of FIG. 1A. Shown on the right of the screen are the Bingo column guide 52 and Bingo number list 51 which is cleared at the start of every game. Each time a number is generated and announced, that number is displayed and listed on the number list 51 at the designated position. The list will serve in verifying the numbers of a winning card. The letter section 53 and the number section 54 are areas where graphic images of bright colors are displayed. Numbers and letters are graphically formed in these sections to show to the players the last number generated and its corresponding 'B','I','N','G','O' letter. The combined height of the number and letter is about the size of the screen; which is large enough to be seen and read at a considerable distance. The sections 53 and 54 are also used to display graphical animation, as well as text and messages for the operator. Also shown on the screen below the number list are two elements of game information: the game number 55 being played and the number of calls 56. Title 57 is an optional section on the screen for game information. Moreover, the whole television screen is used to display images at designated periods in the program.

Figure 3:
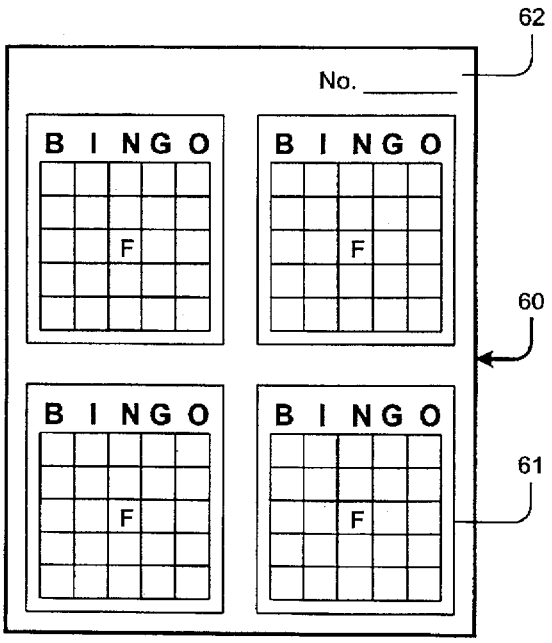
FIG. 3 is a pictorial diagram showing a computer printer output of four bingo cards printed on a standard sheet of paper.

FIG. 3 shows a sample Bingo sheet printout 60. The device can be connected to a computer printer for producing and printing Bingo cards 61 on a standard 8 ½×11 sheet. Four Bingo cards may be printed on one sheet, as shown in the preferred arrangement. Card number 62 may be written on the sheet for proper identification. The Bingo numbers are not shown on FIG. 3. In a preferred embodiment of the system 12 shown in FIG. 1B, the read-only memory 14 includes a printer driver and the game program includes selectable routines for causing the printer 18 to print these playing cards.

Figure 4:
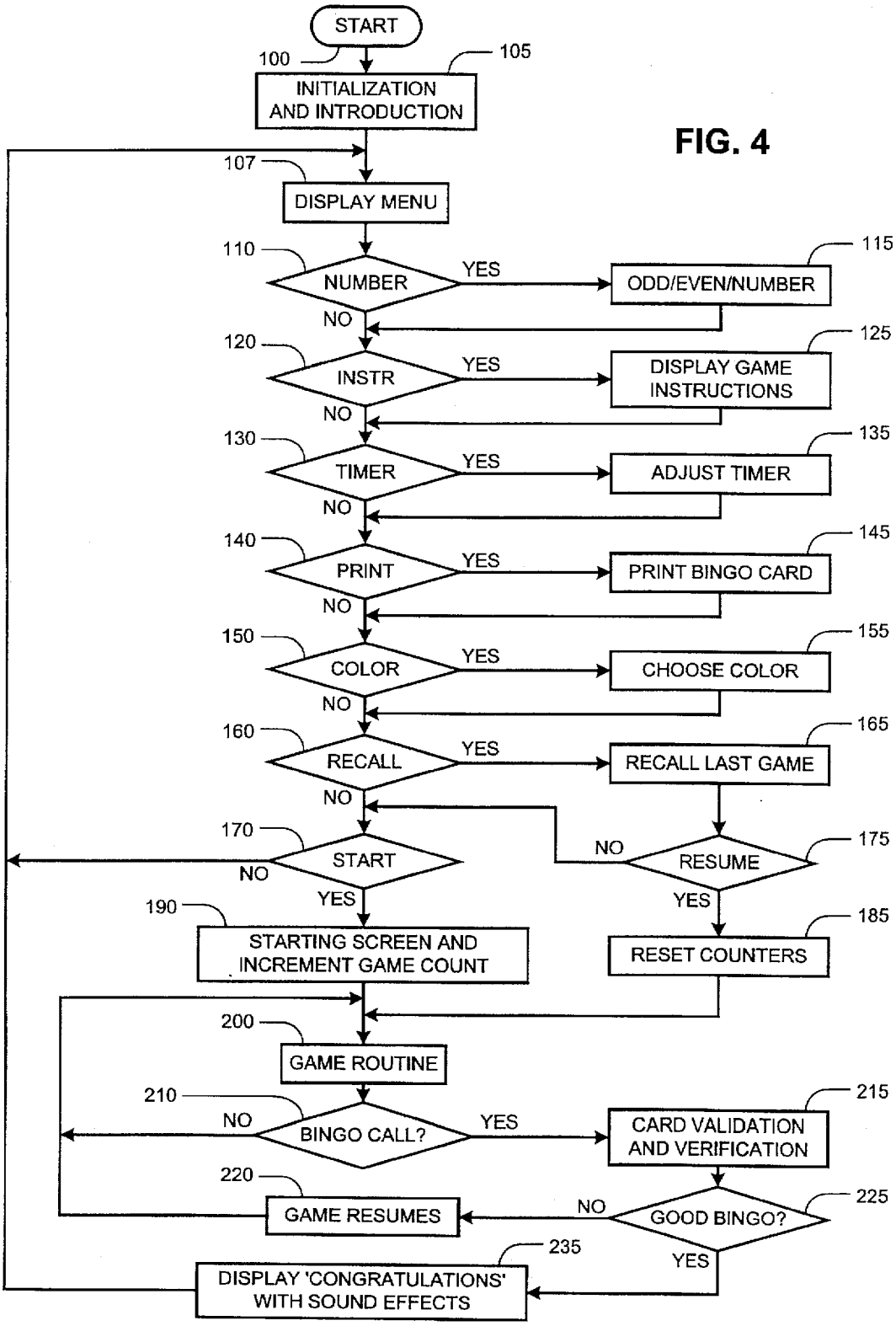
FIG. 4 is a flowchart of a bingo game Main Program for use with the system of FIG. 1A.

FIG. 4 is a flowchart of the main program 100 to play a game. Step by step instructions and operations of this program are better explained at the ensuing Operational Description. In a preferred embodiment of the system 12 shown in FIG. 1B, this main program 100 is stored in the read-only memory 14 and is executed by the CPU 13 which uses the system 12 components to define a game environment which is characterized by a plurality of playing cards, each card having numbers printed on it. The printed numbers are arranged in rows and columns. The main program 100 also pseudo-randomly selects numbers which correspond to the printed numbers during play. The interaction of the main program 100 and the CPU 13, using the control keypad 19 and the television display 23, defines a bingo game.

Figure 5:
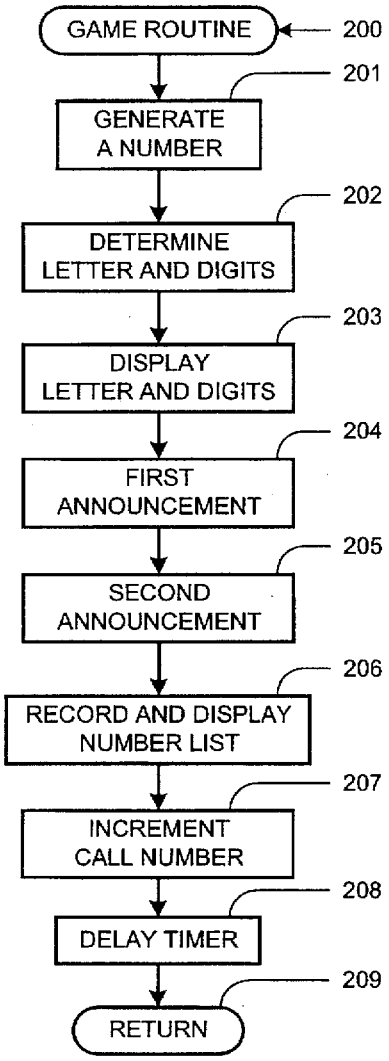
FIG. 5 is a flowchart of a bingo Game Routine and a synthesized bingo announcement procedure as depicted in FIG. 4, element 200.

FIG. 5 is a flowchart of the game routine 200 showing the steps in generating a pseudo-random number and sound for vocalizing the announcement of letters and numbers. This is a part of the main program. Reference should be made to the Operational Description below for a detailed explanation of this program routine.

Figure 6:
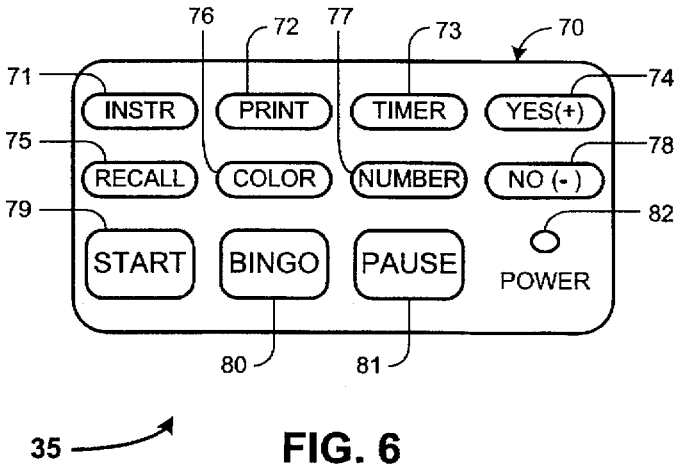
FIG. 6 shows the details of a control keypad and operating keys for a computer component of a preferred embodiment of the system of FIG. 1A.

FIG. 6 shows the details of the control keypad (element 35 of FIG. 1A and element 19 of FIG. 1B) and an arrangement of the control and menu keys. The menu keys are: INSTR key 71, PRINT key 72, TIMER key 73, RECALL key 75, COLOR key 76, NUMBER key 77, and START key 79. These keys are used by the operator to make a selection of the available game options. The control keys are: BINGO key 80, PAUSE key 81, YES key 74 and NO key 78. The YES and NO keys also serve as plus (+) and minus keys(–), respectively. Function of these keys are discussed in the following Operational Description.

Figure 7:
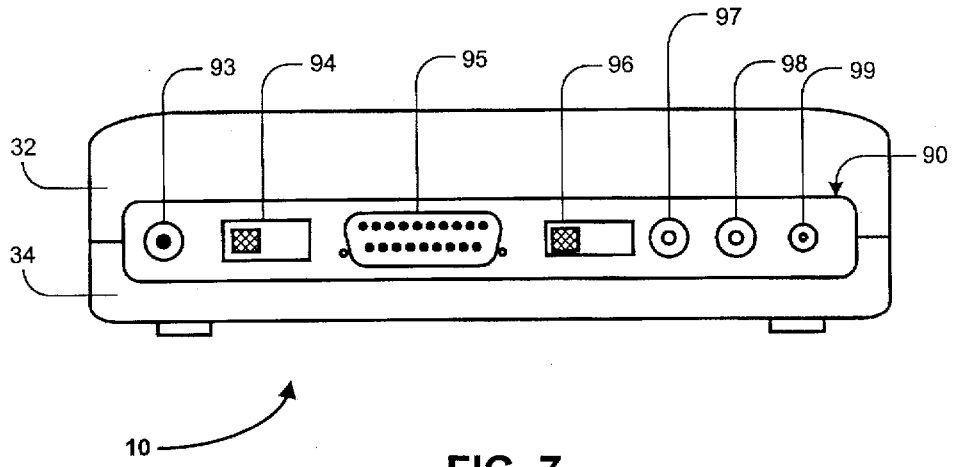
FIG. 7 is an illustration of a rear panel showing an arrangement of input-output terminals and switches for the computer component of a preferred embodiment of the system of FIG. 1A.

FIG. 7 shows the details of the rear panel 90 and the preferred arrangement of the input-output terminals and switches. A commercial AC adapter is applied to the DC input jack 93 to provide the necessary voltage to the device. Power switch 94, which is a slide switch, is provided to turn the power on and off. A printer parallel port 95 is also provided to connect a personal computer printer; such as dot-matrix, ink jet and laser printers. The output signal from the device may be obtained from the audio output jack 97 and video output jack 98. The audio output jack 97 is suitable for both stereo or monaural system. If a VHF signal is required, a coaxial cable is connected at the antenna terminal 99. In case of signal interference, a VHF two-channel selector switch 96 is provided to get a better reception. Television, video monitors, and a small RF transmitter can be connected at these output terminals.

Figure 8:
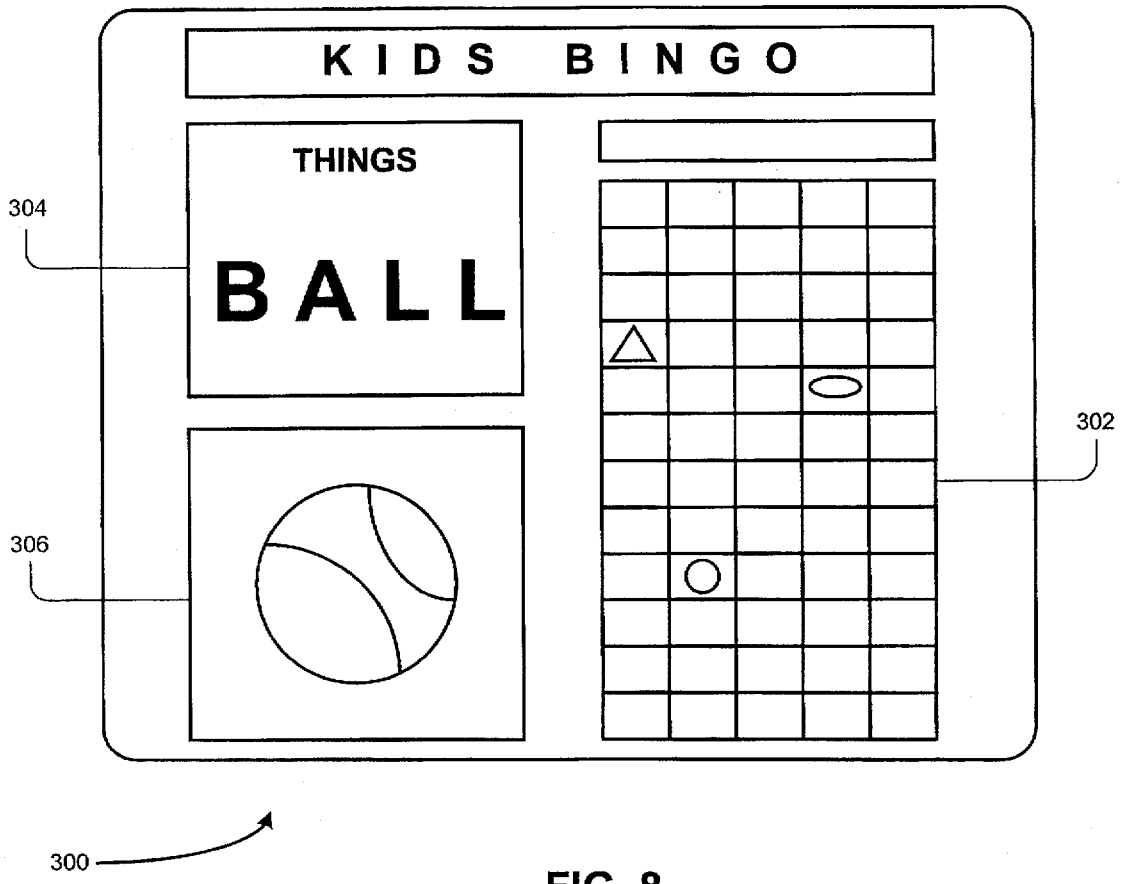
FIG. 8 is a pictorial diagram showing a video display in which graphical symbols are used to replace the bingo numbers.

Finally, FIG. 8 is a pictorial diagram illustrating the use of graphical images, symbols and figures instead of numbers to enable kids and persons who cannot read numbers to play the electronic game. These colored images are geometric figures, cartoon characters, fruits, animals and other things. FIG. 8 shows a display screen similar to the screen illustrated in FIG. 2. The display is indicated generally by the numeral 300 and includes graphical images tally 302, the image classification and description 304 and the graphic image area 306. Each time a random number is generated, its corresponding graphical image is displayed on 302 and area 306, together with a worded description 304.

Operational Description

A person having an ordinary level of skill in the art will understand that the following description defines a relationship between the computer (13 of FIG. 1B) execution of the steps of the main program 100, including the steps of the game program 200, a system operator's use of the control buttons which are illustrated in FIG. 6 and are identified as the control keypad 35 in FIG. 1A and as the control keypad 19 in FIG. 1B, and the system operator's and the game players' response to the displayed information on the television set 40 of FIG. 1A and the television display 23 of FIG. 1B. In this context, the following description defines an electronic video bingo game.

When the power switch 94 is turned on, the computer system 10 is booted. The system 10 runs a power-on self diagnostic check for faults and informs an operator of its state. If the system 10 is functioning properly, an operating system and the main program 100 are loaded and initialization begins.

Before the start of a game, the players choose their cards and specify which cards to enter play. In larger operations, the cards provided to players can be validated and entered in advance. The operator will announce to all players which type of winning game pattern is to be played; such as straight, blackout, square or any other pattern. Then the operator may announce the start of the game.

Referring to FIG. 4, the game starts at 100. Then the program defines and initialize the variables and counters at 105. In the system 12 of FIG. 1B, these are stored in CPU registers (not shown) and in the random-access memory 15. Here, an introduction screen (not shown) showing some details about the game is displayed on the screen 40. This is accompanied with amusing graphics animation and pleasing sound effects to entice the players. Then the menu selection 107 is shown on the screen. The menu screen prompts the operator to press a menu key (see the discussion above relating to FIG. 6), and loops back until a menu key is pressed. The menu keys are operative only when the menu screen is displayed. If one of the menu keys is pressed, the operator may do certain game tasks, as discussed below. To end the menu session, the same menu key is pressed a second time and the menu screen is displayed again for other options.

When the NUMBER key 77 is pressed at 110, the operator can select the type of game or numbers to be pseudo-randomly generated at 115. These options which are shown on the screen are: the set of odd numbers only, the set of even numbers only, the set of all odd and even numbers and the graphics game. The default option that is highlighted is the odd and even numbers, which is the regular set of numbers from 1 to 75. In the graphics game, graphical images, graphical symbols and figures are displayed on the screen instead of numbers. These colored images which are stored in the program are represented by the numbers 1 to 75. The other game options are applicable to speed up a game of blackout. The plus (+) and minus (–) keys are pressed to get the desired option and selection is made by pressing the NUMBER key 77 a second time.

When the INSTR key 71 is pressed at 120, game instructions from a text file are shown on the screen, at subroutine 125. The text file is included in the program. To access the previous and next pages of the text file, the plus (+) and minus (–) keys are used, respectively.

The TIMER key 73, if pressed at 130, is used to adjust the time delay or interval, at 135. This is the interval from the moment the announcement of the number is made to the moment before the next number is generated. It is adjusted from any value of one to sixty seconds, and the default time delay is about seven seconds. The plus and minus keys are used to get the desired number of seconds, and a selection is made by pressing TIMER key 73 again.

When the PRINT key 72 is pressed at 140, the system checks if a printer is properly connected and matches the corresponding printer driver. If something is wrong, an error message is displayed and the menu screen appears. Otherwise, the computer printer is initialized and starts the Bingo card printing process at 145. The numbers printed on the sheet are randomly generated by the program. The program makes sure that a number is not duplicated on one card. The plus and minus keys are used to select the number of sheets to be printed. To stop printing and exit menu, the PRINT key 72 is pressed a second time.

If the COLOR key 76 is pressed at 150, the operator may choose different color combinations for the background, text and graphic images on the screen. At 155, the different color combinations are shown on the screen while the default combination is highlighted. The plus and minus keys are used to highlight the desired color combination, and a selection is made by pressing the COLOR key 76 a second time.

Still referring to FIG. 4; if the RECALL key 75 is pressed at 160, the last or previous game is recalled and shown on the screen. At 165, all the numerical information and the display screen at the time the previous game was stopped, are displayed. This feature is necessary to check another winning card, that is, a late Bingo call; or an error was made during the validation and verification procedure. Then the operator is prompted at 185 whether that game has to be resumed or not. Here, the YES key 74 or NO key 78 is used. If the YES key is pressed, the variables and counters are reset to their previous values and the game resumes. A sound effect is also produced and heard from the speakers to inform the players. If the NO key is pressed, program will return to the menu screen.

When the START key 79 is pressed at 170, the program starts a new game. At 190, the whole screen is cleared and a new starting screen is displayed, similar to FIG. 2. In here; the number list 51, BINGO column guide 52, letter section 53, number section 54, game number 55, number of calls 56, and title 57 are all outlined. Also sound effects and animation are performed to indicate the start of a new game. Next, the game number 55 is incremented and displayed on the screen; while other variables and counters are given the required starting values.

Then the program proceeds to the game routine at 200. Referring to FIG. 5, a pseudo-random number is generated by the program at 201. The range of numbers in standard Bingo game is from 1 to 75, but it is not limited to this range. The game routine is programmed to generate each number with equal probability and to make sure that a number is not generated more than once in a single game. The generated number is then passed on to 202 where three additional data are determined. The data required are: the second significant digit, the first significant digit, and the corresponding Bingo letter. If the number generated is less than ten, the second significant digit is zero and discarded. These data are provided to the audio signal generator and graphics generator. At 203; the letter, second digit and first digit are displayed graphically on the screen. The figures are displayed one at a time in this order, with a few seconds interval. This is accompanied by a sound effect as the figures come out on the screen. At the first announcement 204, audio signals are generated to produce sound for the letter and the whole number. Then the letter and whole number are announced on the speakers in two steps: the letter and then the whole number. An example of the first announcement is: 'I'- 'Seventeen'. At the second announcement 205, audio signals are generated to produce sound for the letter, the second digit and the first digit. The letter and digits are announced in three steps: the letter, the second digit, and the first digit. An example of the second announcement is: 'I'- 'One'- 'Seven'. These announcement are synthesized human speech provided by the sound synthesizing capability of the system 12. After the announcement is made, the program control leads to 206. Each time a number is generated and announced, the number is recorded and displayed on the screen in a designated column and row on the number list 51. Then at 207 the number of calls 56 is incremented and displayed on the screen. At 209, a time delay is executed here in response to the number of seconds predetermined at 135. Other than this delay which is adjustable by the operator, a delay is included that is automatically increasing as each game progresses. The game routine is then completed and program control is returned to 210.

Referring again to FIG. 4, the program checks at 210 if the BINGO key 80 is pressed. The BINGO key 80 is pressed by the operator when a 'Bingo' is called by a player. If not pressed, the program loops back to the game routine 200 to generate the next number and the game continues. If it is pressed, a sound is generated and an announcement is heard to indicate a Bingo call. Then card validation and verification procedure is done by the operator or a third person at 215. This is a manual function to check if a winning card is entered in that game or not. The numbers on the card are also checked against the number list 51 and to match the winning game pattern. After this procedure, the operator is prompted at 225 if the card is a good Bingo or not. If NO key 78 is pressed, a crashing sound is produced to indicate a bad call and the game resumes at 220, and back to game routine 200. If YES key 74 is pressed, a word of "CONGRATULATIONS" is displayed on the screen together with pleasing sound effects and animation. Then the program loops back to 107 and the menu screen is displayed to be ready for the next game and other options.

Thus the reader will notice that the present invention provides a highly reliable, accurate, lightweight, expandable, yet inexpensive electronic Bingo game device that can be used at homes, by small group or larger operations.

Although the description above contains many details and specifics, these should not be construed as limiting the scope of the invention but as merely providing illustrations of some of the presently preferred embodiments of this invention. Various other embodiments and ramifications are possible within it's scope. For example, the START key 79 and the PAUSE key 81 may be combined as a single key to serve both functions; or all of the menu keys may be replaced by four cursor keys with the menu selection displayed on the screen.

Accordingly, the scope of the invention should be determined not only by the examples given, but by the appended claims and their legal equivalents.

What is claimed is:

1. An interactive display system, comprising:

a programmable central processing unit including input/output ports and memory for storage of programs and data;

a game program stored in the memory and executable by the central processing unit, the game program including a pseudo-random number generator providing a non-repeating sequence of integers from the range 1 to 75, inclusive, the sequence defining the called numbers of a bingo game an input device defining a sequence of game play and connected to an input port of the central processing unit for altering the sequence by permitting an operator input;

a color display monitor connected to an output port of the central processing unit for displaying the called bingo game; and the game program and the central processing unit employing computer graphics processing to provide bingo game information to the color display monitor, as well as graphic images and animation.

2. The interactive display system as set forth in claim 1, wherein the color display monitor also displays a number list showing the numbers which have been called, the number list being updated each time a number is called.

3. The interactive display system as set forth in claim 1, further including a printer connected to an output port of the central processing unit and controlled by a printer driver program stored in the memory, and the game program including routines selectable for printing bingo cards.

4. The interactive display system as set forth in claim 3, wherein the game program further includes routines for converting the called numbers to graphical images and symbols for display, the graphical images and symbols forming a defined set, each image and symbol corresponding to a different integer in the range 1 to 75, inclusive, and the bingo game program displaying the graphical images and symbols converted from the called numbers.

5. The interactive display system as set forth in claim 1, further including a video card connected to an output port of the central processing unit and providing a video output signal, and an audio card connected to an output port of the central processing unit and providing an audio output signal.

6. The interactive display system as set forth in claim 5, further including a VHF transmitter connected to receive the video output signal and the audio output signal for radio transmission of these signals.

7. The interactive display system as set forth in claim 4, further including a video display monitor, the video display monitor having a radio receiver tuned to receive transmissions of the VHF transmitter.

8. The interactive display system as set forth in claim 6, further including a television receiver tuned to receive transmissions of the VHF transmitter for display of the bingo game.

9. The interactive display system as set forth in claim 1, wherein the game program and the central processing unit provide sound effects and synthesized human speech to speakers, and further wherein the sound effects and the synthesized human speech are stored and retrieved from memory.

10. The interactive display system as set forth in claim 9, wherein the synthesized human speech simulates the announcement of bingo numbers, letters and words in a bingo game.

11. The interactive display system as set forth in claim 1, wherein the bingo game information and the graphic images includes words, letters, numbers, figures and pictures.

12. The interactive display system as set forth in claim 1, wherein the input device includes a cursor pointing device controlled by a driver program stored in memory.

* * * * *